US006244078B1

(12) United States Patent
Thompson et al.

(10) Patent No.: US 6,244,078 B1
(45) Date of Patent: Jun. 12, 2001

(54) DRIVE SYSTEM FOR WASHING MACHINE

(75) Inventors: Robert Alan Thompson, Quaker Street; Sudhir Dattatraya Savkar, Schenectady, both of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/222,000

(22) Filed: Dec. 29, 1998

(51) Int. Cl.[7] ..... D06F 37/40
(52) U.S. Cl. ..... 68/23.7; 68/133; 74/25
(58) Field of Search ..... 68/23.7, 133, 23 R; 74/25, 36

(56) References Cited

U.S. PATENT DOCUMENTS 3,783,652 * 1/1974 Archbold .
3,907,082 * 9/1975 Shikamori et al. .
5,033,278 * 7/1991 Hossfield .
5,209,085 * 5/1993 Brien .
5,509,284 * 4/1996 Hauser ..... 68/23.7
5,522,242 * 6/1996 Hauser ..... 68/23.7
5,605,212 2/1997 Hauser ..... 192/12 BA
5,740,701 4/1998 Hauser ..... 74/570
5,809,808 9/1998 Andriano et al. ..... 68/23.7
6,105,032 * 1/2000 McGourthy, Jr. et al. .

* cited by examiner

*Primary Examiner*—Frankie L. Stinson
(74) *Attorney, Agent, or Firm*—David C. Goldman; Jill M. Breedlove

(57) ABSTRACT

Bearing fretting conditions are eliminated in washing machines by providing a drive system in which the bearings are not loaded during the spin mode. The drive system includes an input shaft and first and second hubs rotatively mounted about the input shaft. The second hub is movable along the input shaft between a first position adjacent to the first hub and a second position displaced from the first hub. The drive system spins the washing machine's basket when the second hub is in its first position and oscillates the agitator when the second hub is in its second position. A brake disk is mounted to the second hub for movement therewith, and a brake surface is fixedly mounted to the washing machine adjacent to the brake disk so that the brake disk contacts the brake surface when the second hub is in its second position. Separation of the two hubs is accomplished by ball bearings which are unloaded when the second hub is in its first position.

19 Claims, 6 Drawing Sheets

DRIVE SYSTEM FOR WASHING MACHINE

BACKGROUND OF THE INVENTION

This invention relates generally to domestic washing machines and more particularly to a drive system for agitating and spinning appropriate elements of the washing machine.

Conventional washing machines typically include a perforated basket for holding clothing or other articles to be washed, an agitator disposed within the basket which agitates the clothes in the basket, and a motor which drives the agitator and the basket. The articles to be washed are immersed in water with detergent and washed under the influence of an oscillating agitator. After agitation, the articles are rinsed with clean water and the basket is spun at high speed to centrifugally extract the rinse water from the articles. Typically, a mechanical drive system produces the oscillatory motion of the agitator upon rotation of a drive motor in one direction, and produces continuous rotation of the basket upon rotation of the drive motor in the other direction.

U.S. Pat. No. 5,605,212, issued Feb. 25, 1997 to Hans Hauser, is exemplary of such a drive system. The Hauser patent discloses a drive system including a bi-directional motor that can reverse its rotation direction to achieve different modes in the wash cycle. The motor rotates in a first direction during the agitate mode and in a second direction, opposite the first direction, during the spin mode. A transmission is provided with gears to convert the rotary motion of the motor into oscillatory motion of the agitator during agitation; during the spin mode, the transmission transfers motor rotation to the basket. The Hauser drive system further includes a spring loaded clutch/brake mechanism that holds the basket immobile during agitation mode. This mechanism uses a ball and hub assembly to engage or disengage the brake. The ball and hub assembly includes two rotatively mounted hubs having a plurality of ball bearings disposed therebetween in inclined races. The uppermost of the two hubs supports a spring loaded brake disk. When in the agitation mode, the balls remain at the bottom of the inclined races and the brake disk is biased into contact with a stationary brake drum, so that the brake is locked. When the wash cycle calls for the spin mode, the direction of motor rotation is reversed. This causes the balls to run up the inclined races, lifting the uppermost hub and the brake disk, thereby unlocking the brake. With the brake released, the transmission transfers motor rotation to the basket, resulting in the desired spinning of the basket.

Although generally operating in a satisfactory manner, this type of drive system suffers from a potential drawback in that the ball bearings are most highly loaded when the dynamic loading conditions are the worst, i.e., during spin mode. As the basket approaches its terminal speed during spin mode, the accelerating torques diminish and the brake spring force starts to force the balls back down their races. This causes the brake disk to descend until the disk tags the drum, increasing the torque, reversing the process, and re-releasing the brake. Tagging repeats over and over so that small motion of the highly loaded balls up and down the races can be stimulated, a condition that can produce fretting wear of the ball races. If the fretting becomes severe, a detent large enough to inhibit free ball rolling can develop and lead to possible brake failure. Furthermore, uneven distribution of wet clothes in the basket can aggravate the problem because large unbalanced loads during spin can concentrate the load onto one or two of the balls instead of being shared equally among the balls.

Accordingly, there is a need for an improved washing machine drive system in which the ball bearings are not loaded during the spin mode, thereby eliminating tagging and severe fretting conditions.

SUMMARY OF THE INVENTION

The above-mentioned needs are met by the present invention which provides a washing machine drive system having an input shaft and first and second hubs rotatively mounted about the input shaft. The second hub is movable along the input shaft between a first position adjacent to the first hub and a second position displaced from the first hub. The drive system spins the washing machine's basket when the second hub is in its first position and oscillates the agitator when the second hub is in its second position. A brake disk is mounted to the second hub for movement therewith, and a brake surface is fixedly mounted to the washing machine adjacent to the brake disk so that the brake disk contacts the brake surface when the second hub is in its second position. Separation of the two hubs is accomplished by ball bearings that are unloaded when the second hub is in its first position. Thus, the present invention eliminates tagging and severe fretting conditions while retaining the fail safe braking feature of conventional systems.

Other objects and advantages of the present invention will become apparent upon reading the following detailed description and the appended claims with reference to the accompanying drawings.

DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
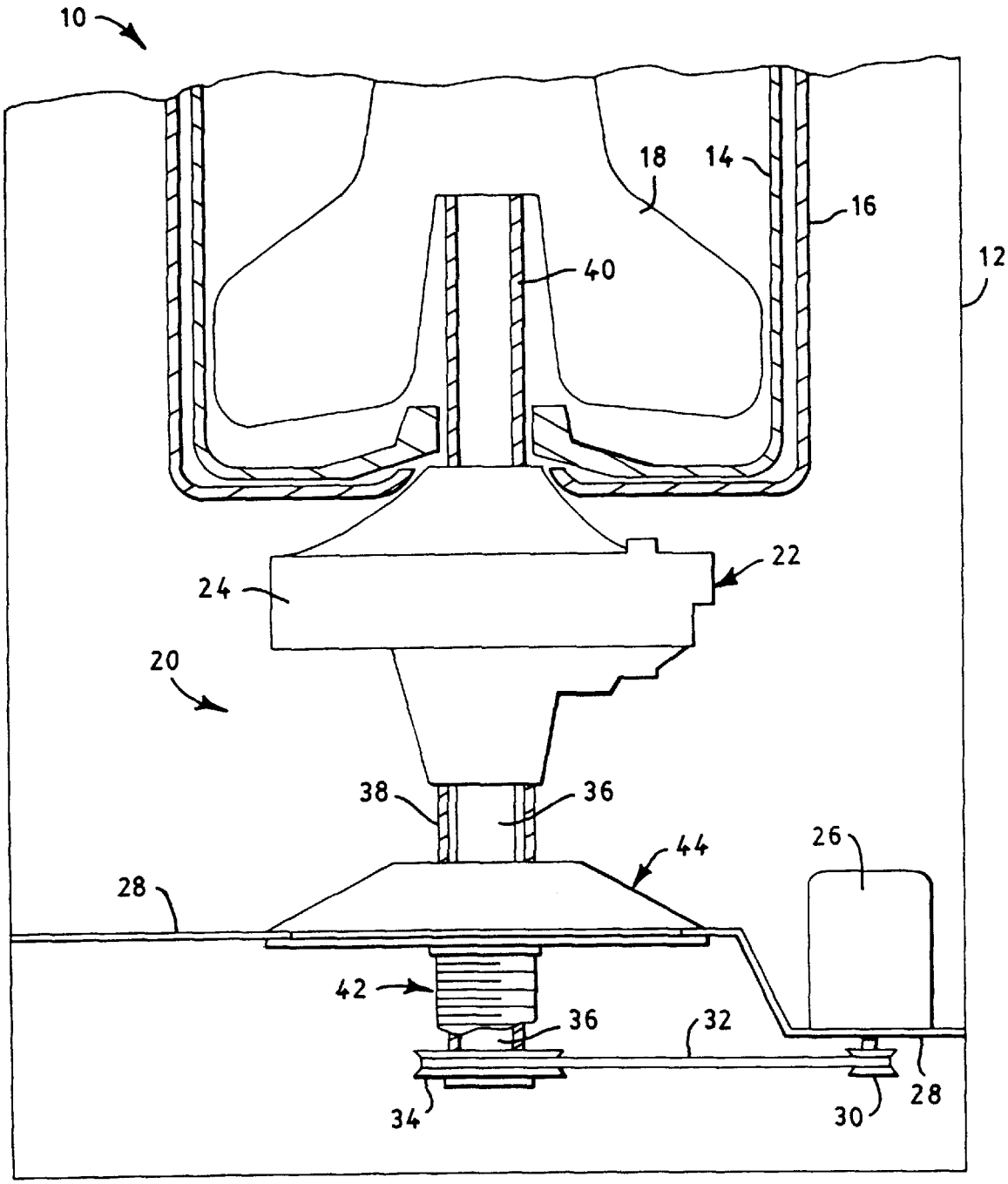
FIG. 1 is an elevational view, in cross-section, of a washing machine having the drive system of the present invention.

Referring to the drawings wherein identical reference numerals denote the same elements throughout the various views, FIG. 1 schematically shows a washing machine 10 including a cabinet 12 having a door (not shown) to permit access to the interior of washing machine 10. Washing machine 10 also includes a perforated basket 14 that is rotatively mounted within an imperforate tub 16. An agitator 18 is rotatively mounted within basket 14. Washing machine 10 also includes a conventional control system (not shown), typically mounted to the upper surface of cabinet 12, to allow a user to set the desired operating cycle. Typically, the operating cycle includes filling tub 16 with wash water (e.g., water and detergent), oscillating agitator 18 so that the clothes or other articles disposed in basket 14 for washing are mixed with the wash water, draining the wash water from tub 16 after agitation is completed, filling and draining tub 16 one or more times with rinse water, and spinning basket 14 to centrifugally extract water from the clothes.

Washing machine 10 has a drive system 20 for oscillating agitator 18 and spinning basket 14. Drive system 20 includes a transmission 22 contained within a housing 24 and a reversible electric motor 26 capable of bi-directional rotation, the direction of rotation depending on the washing machine control system. In addition to being bi-directional, motor 26 can have variable speeds so as to vary the duty cycle under control of the control system. Motor 26 is supported by a frame 28 in washing machine 10 and has a drive pulley 30 fixedly mounted to its output shaft. Motor rotation is transferred through drive system 20 by a drive belt 32 connecting drive pulley 30 to an input pulley 34. Input pulley 34 is fixedly connected to the lower end of an input shaft 36, the other end of which is rotatively connected to transmission 22. A basket drive shaft 38 is rotatively mounted concentrically about input shaft 36 and is fixedly connected to or integral with the lower side of transmission housing 24. The other side of transmission housing 24 is fixedly connected to basket 14 so that rotation of housing 24 will cause rotation of basket 14. Agitator 18 is coupled to drive system 20 by an agitator drive shaft 40 that is rotatively connected to transmission 22 and fixedly connected to agitator 18. Drive system 20 further includes a clutch assembly 42 and a brake assembly 44, both of which are described more fully below, that cooperate with transmission 22 to oscillate agitator 18 and spin basket 14.

Drive system 20 has two alternate modes of operation depending on the direction of rotation of motor 24. In a first or agitation mode, motor 26 is caused to rotate in a first direction (this first direction is counterclockwise as viewed from the bottom of FIG. 1 for the purpose of illustration but could also be clockwise) thereby causing input shaft 36 to also rotate in this direction. The counterclockwise rotation of input shaft 36 causes clutch assembly 42 to activate or set brake assembly 44 so that basket drive shaft 38, and hence transmission housing 24, are locked with respect to frame 28. Input shaft 36 thus rotates with respect to transmission housing 24, which in turn causes transmission 22 to oscillate agitator 18 via agitator drive shaft 40. In a second or spin mode, motor 26 is reversed to rotate in a clockwise direction such that input shaft 36 also rotates in a clockwise manner. The clockwise rotation of input shaft 36 is transmitted to basket drive shaft 38 via clutch assembly 42 and brake assembly 44 is released. Accordingly, basket drive shaft 38 and transmission housing 24 rotate along with input shaft 36. The rotation of housing 24 causes basket 14 to rotate, thereby producing the desired spinning. And because housing 24 rotates with input shaft 36, there is no relative rotation of shaft 36 and transmission 22 so that agitator 18 is not oscillated.

Figure 2:
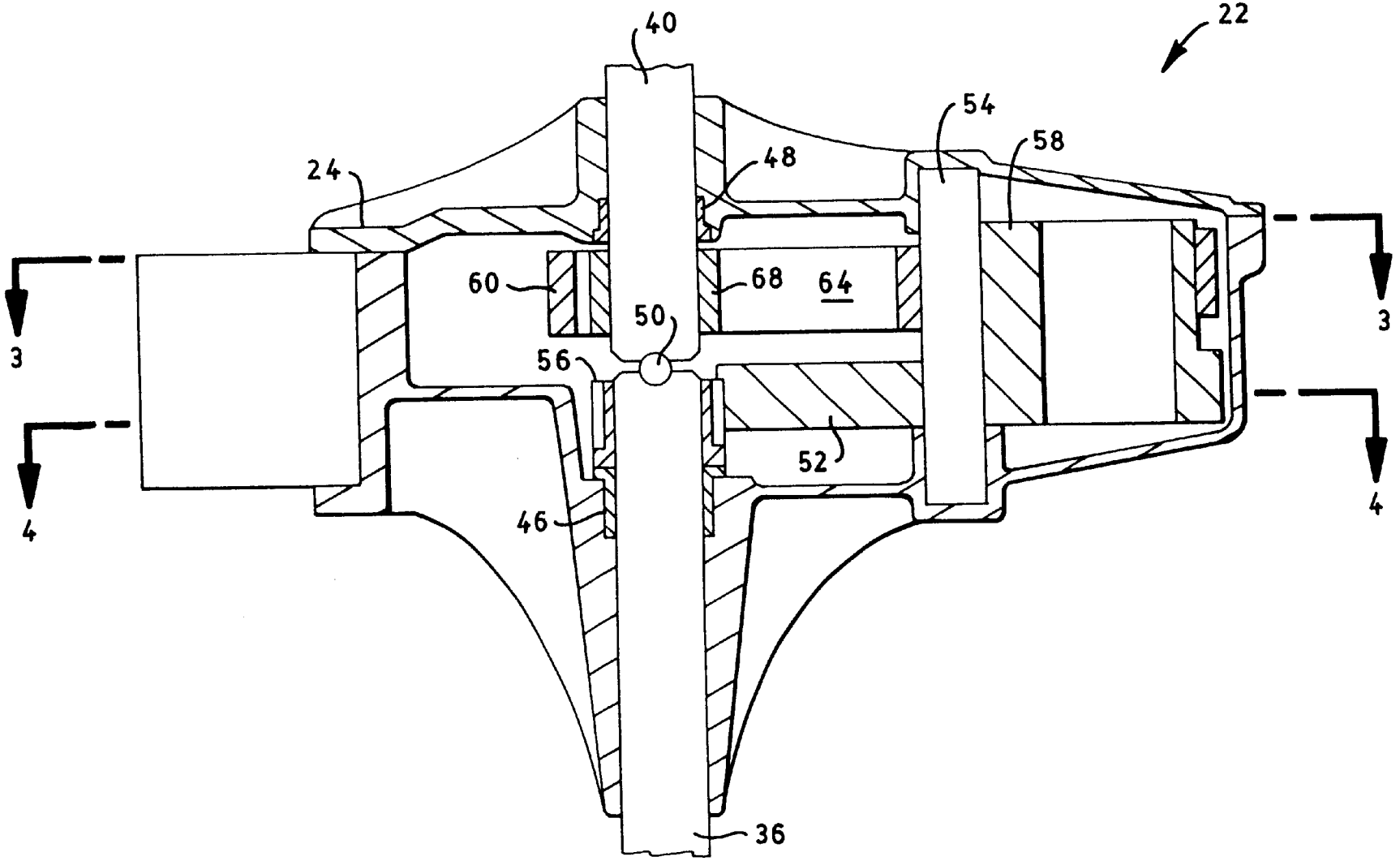
FIG. 2 is a sectional view of the transmission of the drive system of the present invention.
Figure 3:
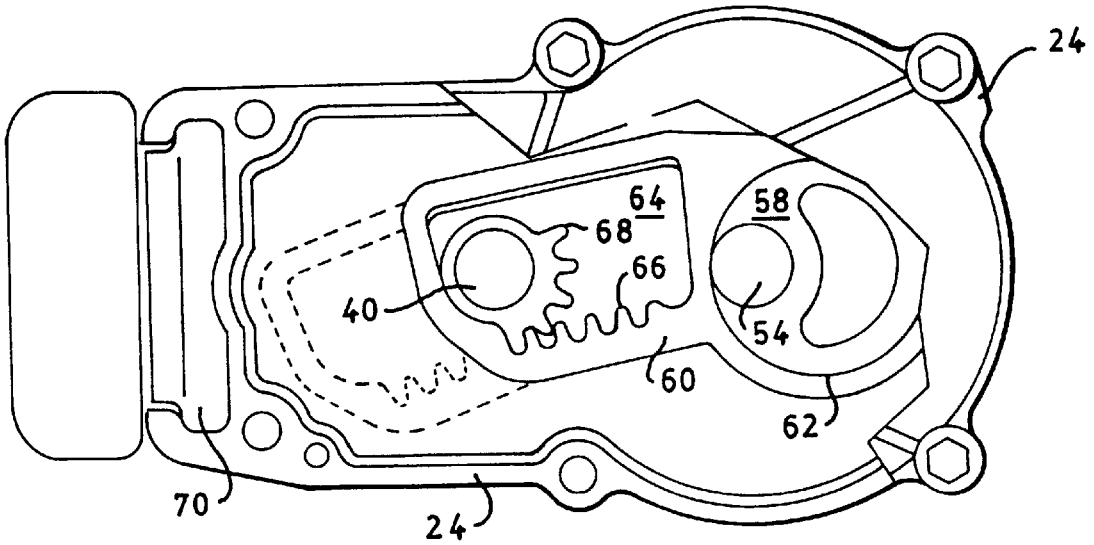
FIG. 3 is a sectional view of the transmission of FIG. 2 and taken generally along line 3—3.
Figure 4:
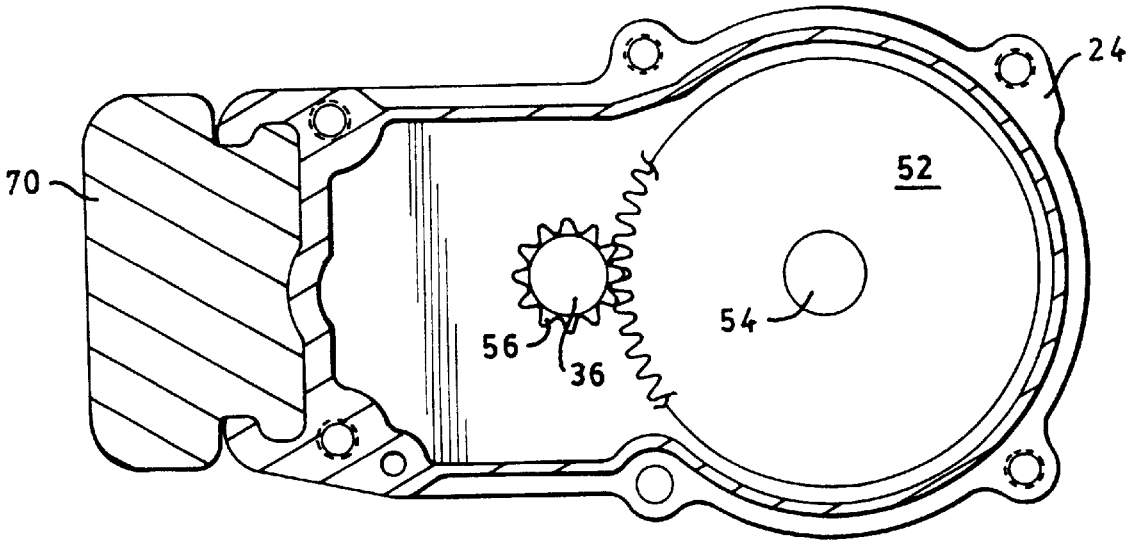
FIG. 4 is a sectional view of the transmission of FIG. 2 and taken generally along line 4—4.

Referring to FIGS. 2–4, transmission 22 is shown in more detail. Input shaft 36 is rotatively mounted in the lower portion of housing 24 by a first bearing 46, and agitator drive shaft 40 is rotatively mounted in the upper portion of housing 24 by a second bearing 48. A ball bearing 50 is provided between the upper end of input shaft 36 and the lower end of agitator drive shaft 40 to axially locate the two shafts and permit relative rotation therebetween. An eccentric gear 52 is rotatively mounted to housing 24 by an idler shaft 54 which is mounted inside housing 24 and extends through the center of eccentric gear 52. As best seen in FIG. 4, eccentric gear 52 is drivingly connected to input shaft 36 by an input pinion 56 splined to the upper end of input shaft 36. Eccentric gear 52 includes an offset shaft 58 extending upwardly therefrom. The center of offset shaft 58 is displaced from the center of eccentric gear 52 such that when eccentric gear 52 is caused to rotate about its center by input pinion 56, offset shaft 58 revolves in a circular fashion about the center of eccentric gear 52.

Transmission 22 further includes an agitator rack 60 having a circular bearing 62 and a cavity 64 with teeth 66 (FIG. 3) and an agitator pinion 68 fixedly attached to the lower end of agitator drive shaft 40. Agitator rack 60 is arranged so that circular bearing 62 is disposed around offset shaft 58 and agitator pinion 68 is in driving contact with rack teeth 66. With this arrangement, the circular motion that offset shaft 58 undergoes in response to eccentric gear 52 rotating about idler shaft 54 causes agitator rack 60 to move back and forth in a reciprocating longitudinal motion. This reciprocating longitudinal motion, via the driving engagement of teeth 66 with agitator pinion 68, causes agitator drive shaft 40 to move back and forth in a reciprocating rotary motion. A counterweight 70 is attached to housing 24 opposite eccentric gear 52 to counter balance the weight of eccentric gear 52 and the other transmission elements.

Turning now to FIGS. 5–9, clutch assembly 42 and brake assembly 44 are described in more detail. Clutch assembly 42 includes a unidirectional helical clutch spring 72 that surrounds a pulley hub 74 that is fixedly connected to or integrally formed on input pulley 34 for rotation therewith in either direction. A ball ramp hub 76 is rotatively mounted concentrically about input shaft 36 by a bearing 78 at a location directly above pulley hub 74. Clutch spring 72 also surrounds ball ramp hub 76 and is helically wound so as to grasp ball ramp hub 76 and cause it to rotate with pulley hub 74 when pulley hub 74 is rotated in the counterclockwise direction, but when pulley hub 74 is rotated in the clockwise direction, clutch spring 72 mostly slips and generally does not cause ball ramp hub 76 to rotate.

Figure 6:
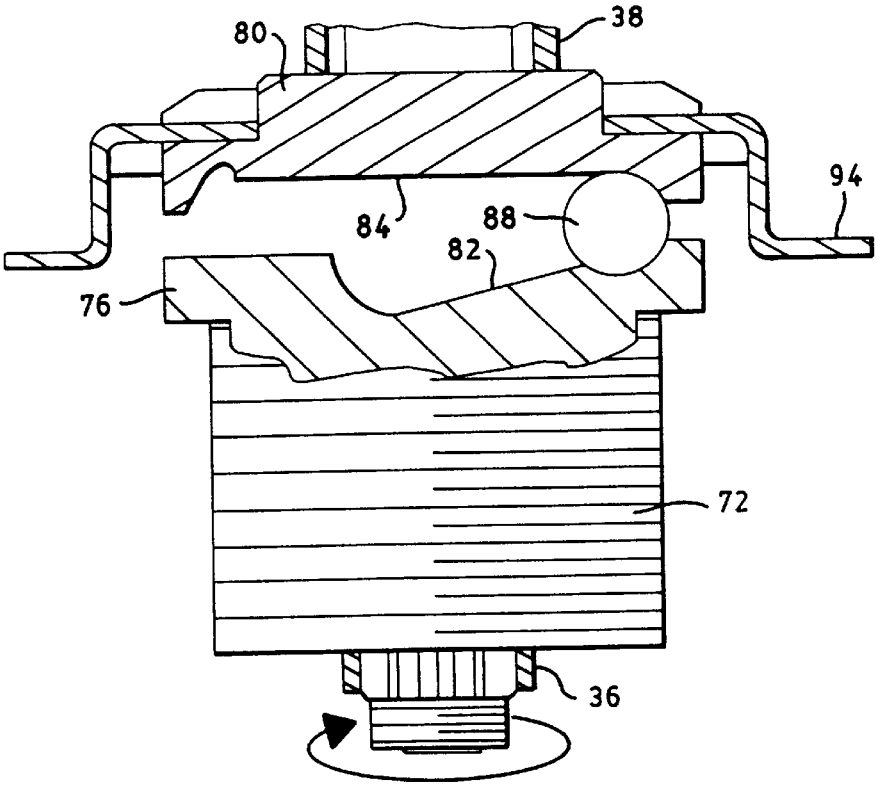
FIG. 6 is an enlarged, partial cutaway view of the clutch assembly of FIG. 5.
Figure 7:
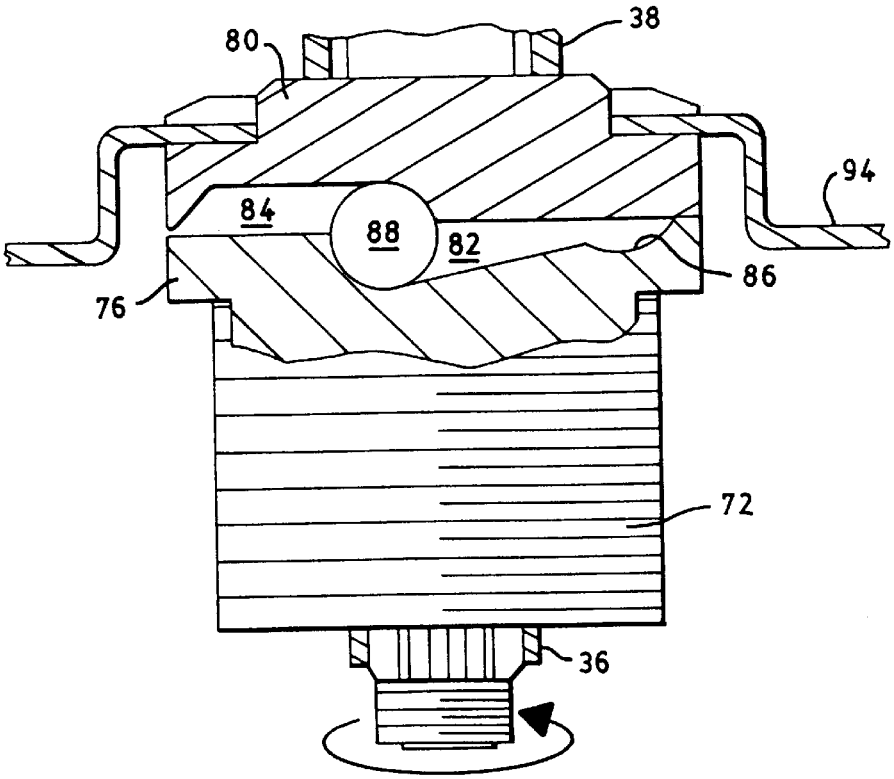
FIG. 7 is another enlarged, partial cutaway view of the clutch assembly of FIG. 5.
Figure 9:
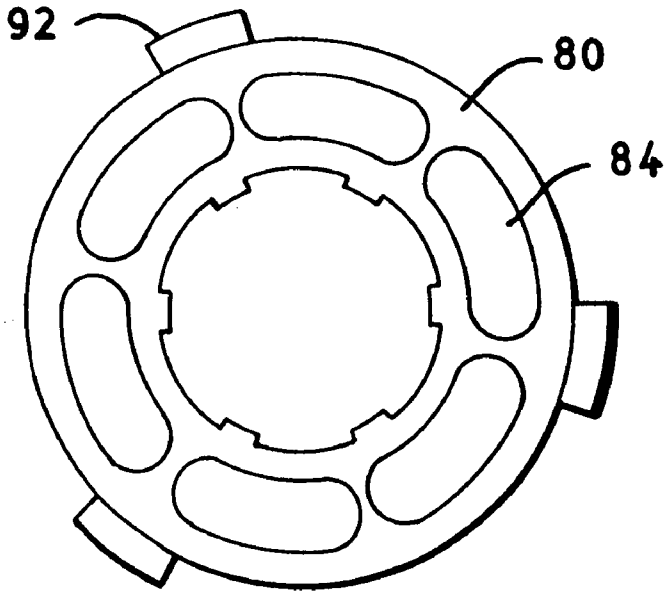
FIG. 9 is a view from below of the brake disk hub of the present invention.
Figure 8:
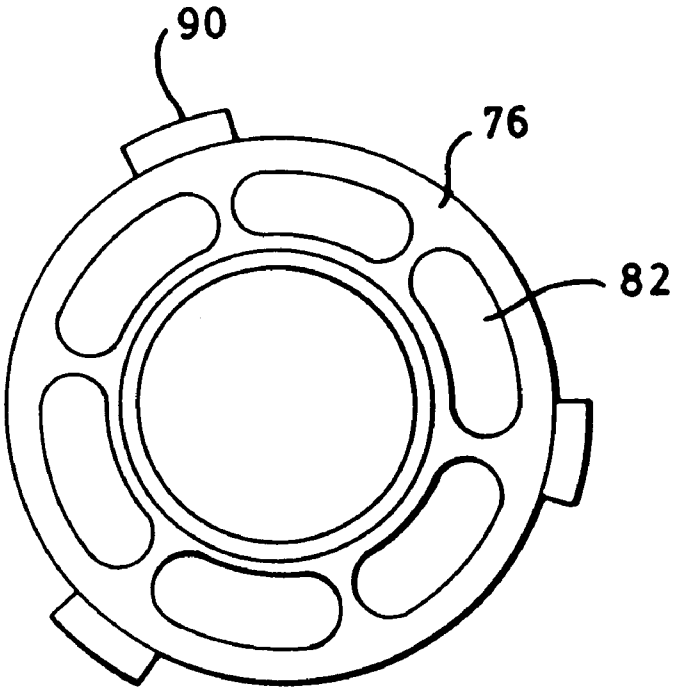
FIG. 8 is a view from above of the ball ramp hub of the present invention.

A brake disk hub 80 is disposed above ball ramp hub 76. Brake disk hub 80, which is also mounted concentrically about input shaft 36, is fixedly connected to basket drive shaft 38 for rotation therewith. Ball ramp hub 76 has a number of inclined races 82 formed in its upper surface, and brake disk hub 80 includes an equal number of races 84 formed in its lower surface. Although FIGS. 8 and 9 show six such races, the present invention is not limited to this number. Inclined races 82 have a detent 86 formed at their shallowest ends. An actuation ball 88 is captured between each pair of races 82 and 84. Actuation balls 88 separate ball ramp hub 76 from brake disk hub 80 and support relative motion therebetween. As seen in FIG. 6, when ball ramp hub 76 is rotated in a counterclockwise direction as viewed from the bottom of FIG. 6 relative to brake disk hub 80, balls 88 run up the ramps defined by inclined races 82 and into detent 86, thereby causing brake disk hub 80 to be lifted with respect to ball ramp hub 76. However, as shown in FIG. 7, when ball ramp hub 76 is rotated in a clockwise direction relative to brake disk hub 80, balls 88 are lifted out of detent 86 and run back down inclined races 82, so that brake disk hub 80 is not lifted with respect to ball ramp hub 76. Thus, brake disk hub 80 is movable along input shaft 36 between a first position adjacent to ball ramp hub 76 (FIG. 7) and a second position displaced from ball ramp hub 76 (FIG. 6).

As best seen in FIGS. 8 and 9, ball ramp hub 76 has a set of tabs 90 located about its outer surface, and brake disk hub 80 has a set of tabs 92 located about its outer surface. Tabs 90 extend beyond the upper surface of ball ramp hub 76, and tabs 92 extend beyond the bottom surface of brake disk hub 80. Tabs 90 and 92 are relatively positioned about the perimeter of their respective hubs so as to engage one another when ball ramp hub is rotated a sufficient amount in the clockwise direction. This corresponds to the condition where actuation balls 88 are down in inclined races 82 and brake disk hub 80 is in its first position (FIG. 7). With tabs 90 and 92 in engagement, brake disk hub 80 is drivingly connected with ball ramp hub 76 so that continued clockwise rotation of ball ramp hub 76 is transferred to brake disk hub 80.

Figure 5:
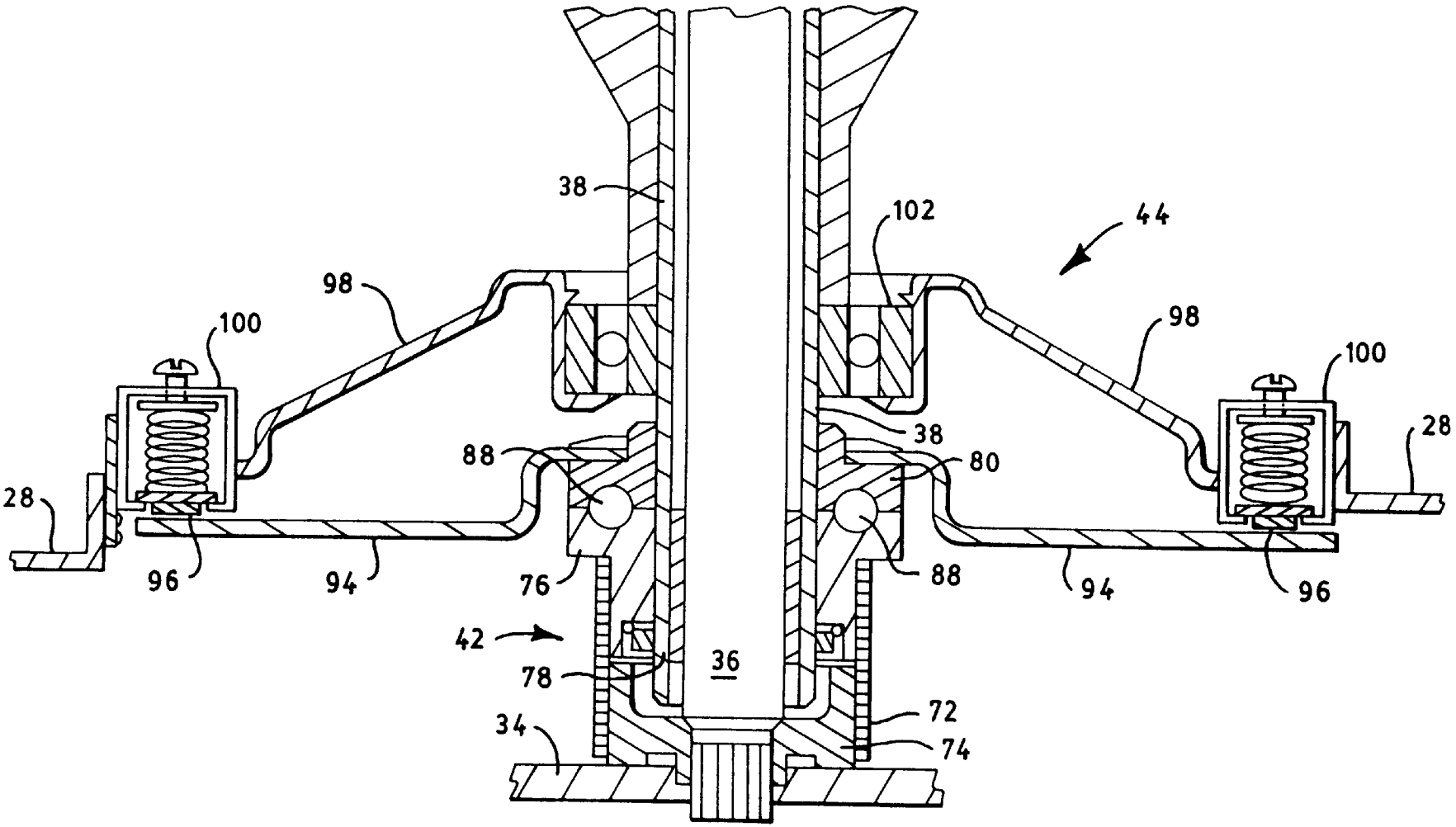
FIG. 5 is an enlarged sectional view of the clutch and brake assemblies of the drive system of the present invention.

Brake assembly 44 includes a brake disk 94 that is fixedly connected to brake disk hub 80 so as to move with brake disk hub 80 when it moves along input shaft 36. A brake surface 96 is mounted directly over the outermost portion of brake disk 94. As shown in FIG. 5, brake surface 96 is a friction pad in the form of a ring (either segmented or continuous) of high friction material mounted to a bearing support member 98 by an adjustable spring loaded fixture 100 which permits adjustment of the contacting force between brake disk 94 and brake surface 96. However, it should be noted that it is within the scope of the present invention to simply affix brake surface 96 directly to bearing support member 98. Bearing support member 98, which also supports a bearing 102 for basket drive shaft 38, is secured to washing machine frame 28. Brake disk 94 and brake surface 96 are positioned relative to one another such that when brake disk hub 80 is lifted from ball ramp hub 76 by actuation balls 88 (i.e., into its second position), brake disk 94 is forced into contact with brake surface 96, thereby locking brake disk hub 80, and hence basket drive shaft 38 and transmission housing 24, against rotation with respect to frame 28.

As mentioned above, drive system 20 has two alternate modes of operation, the agitation mode and the spin mode. During agitation, motor 26 is caused to rotate in a counterclockwise direction as viewed from the bottom of the Figures, which causes pulley hub 74 and input shaft 36 to rotate in the counterclockwise direction as well. Although clutch spring 72 generally slips when pulley hub 74 rotates counterclockwise, there is a sufficient amount of drag torque present in clutch spring 72 to cause the counterclockwise rotation of pulley hub 74 to be transferred briefly to ball ramp hub 76. The counterclockwise rotation of ball ramp hub 76 causes actuation balls 88 to be driven up inclined races 82 and into detents 86. This causes brake disk hub 80 to be lifted into its second position so that brake disk 94 is forced into contact with brake surface 96, thereby setting brake assembly 44 so that basket drive shaft 38 and transmission housing 24 are locked with respect to frame 28. Clutch spring 72 now slips on ball ramp hub 76, but pulley hub 74 and input shaft 36 continue to rotate in the counterclockwise direction. The rotation of input shaft 36 causes transmission 22 to drive agitator drive shaft 40 back and forth in a reciprocating rotary motion. This in turn results in agitation of agitator 18.

At the proper time in the operation of washing machine 10, the spin mode is initiated by reversing the direction of motor 26 so that it rotates in the clockwise direction. Reversal of motor 26 causes pulley hub 74 and input shaft 36 to rotate in the clockwise direction. Now, clutch spring 72 grasps ball ramp hub 76 so as to transfer clockwise rotation to it. The clockwise rotation of ball ramp hub 76 causes actuation balls 88 to be lifted out of detents 86 and driven back down inclined races 82. This causes brake disk hub 80 to be returned to its first position adjacent to ball ramp hub 76 (FIG. 7) so that brake disk 94 does not contact brake surface 96. At this point, tabs 90 and 92 are in engagement so that brake disk hub 80 is drivingly connected with ball ramp hub 76. Accordingly, continued clockwise rotation of motor 26 is transferred to brake disk hub 80 and to basket drive shaft 38 and transmission housing 24 which are free to rotate with respect to frame 28 because brake assembly 44 is released. Rotation of transmission housing 24 is directly transferred to basket 14, producing the desired spinning of basket 14. Because brake disk hub 80 is in its first position during the spin mode, actuation balls 88 are unloaded and not subjected to fretting conditions during the spin mode, when the highest pounding loads are applied to drive system 20. The present invention also provides a fail safe braking feature in that if power is interrupted or motor 26 otherwise fails during the spin mode, inertia and motor drag will cause ball ramp hub 76 to slow with respect to the clockwise spinning basket 14. This will cause actuation balls 88 to be driven up inclined races 82 and into detents 86, lifting brake disk hub 80 into its second position and setting brake assembly 44, thereby stopping spinning of basket 14.

Although the present invention has been described such that counterclockwise motor rotation produces agitation of agitator 18 and clockwise motor rotation produces spinning of basket 14, this is for the purposes of illustration only. It should be understood that the present invention could also be configured such that counterclockwise motor rotation produces the spin mode and clockwise motor rotation produces the agitation mode.

The foregoing has described a washing machine drive system that produces agitation of the agitator and continuous direct spin of the basket. While specific embodiments of the present invention have been described, it will be apparent to those skilled in the art that various modifications thereto can be made without departing from the spirit and scope of the invention as defined in the appended claims.

What is claimed is:

1. A drive system for a washing machine, said drive system comprising:

an input shaft;

a first hub rotatively mounted about said input shaft;

a second hub rotatively mounted about said input shaft, said second hub being movable along said input shaft between a first position adjacent to said first hub and a second position displaced from said first hub;

a number of races formed in said first hub, an equal number of races formed in said second hub, and an actuation ball disposed between each one of said races formed in said first hub and a corresponding one of said races formed in said second hub;

a brake disk mounted to said second hub for movement therewith; and a brake surface fixedly mounted to said washing machine adjacent to said brake disk so that said brake disk contacts said brake surface when said second hub is in said second position.

2. The drive system of claim 1 wherein said brake disk does not contact said brake surface when said second hub is in said first position.

3. The drive system of claim 1 wherein said races in at least one of said first and second hubs are inclined.

4. The drive system of claim 3, wherein each one of said inclined races has a detent formed at one end thereof.

5. The drive system of claim 1 further comprising a motor and means for coupling said motor to said input shaft.

6. The drive system of claim 5 further comprising a clutch spring, said clutch spring configured to transfer rotation of said input shaft to said first hub upon rotation of said input shaft in a first direction.

7. The drive system of claim 6 wherein said actuation balls cooperate with said races formed in said first hub and said races formed in said second hub to move said second hub to its first position upon rotation of said input shaft in said first direction and to move said second hub to its second position upon rotation of said input shaft in a second direction.

8. The drive system of claim 1 further comprising a basket drive shaft fixedly connected to said second hub.

9. The drive system of claim 1 further comprising a transmission connected to said input shaft and an agitator drive shaft connected to said transmission, said transmission converting continuous rotation of said input shaft in one direction into reciprocating back and forth rotation of said agitator drive shaft.

10. A drive system for a washing machine having a basket and an agitator, said drive system comprising:

an input shaft;

a first hub rotatively mounted about said input shaft;

a second hub rotatively mounted about said input shaft, said second hub being movable along said input shaft between a first position adjacent to said first hub and a second position displaced from said first hub, wherein said drive system spins said basket when said second hub is in said first position and oscillates said agitator when said second hub is in said second position; and a number of races formed in said first hub, an equal number of races formed in said second hub, and an actuation ball disposed between each one of said races formed in said first hub and a corresponding one of said races formed in said second hub.

11. The drive system of claim 10 further comprising:

a brake disk mounted to said second hub for movement therewith; and a brake surface fixedly mounted to said washing machine adjacent to said brake disk so that said brake disk contacts said brake surface when said second hub is in said second position.

12. The drive system of claim 11 wherein said brake disk does not contact said brake surface when said second hub is in said first position.

13. The drive system of claim 10 wherein said races in at least one of said first and second hubs are inclined.

14. The drive system of claim 13 wherein each one of said inclined races has a detent formed at one end thereof.

15. The drive system of claim 10 further comprising a motor and means for coupling said motor to said input shaft.

16. The drive system of claim 15 further comprising a clutch spring, said clutch spring configured to transfer rotation of said input shaft to said first hub upon rotation of said input shaft in a first direction.

17. The drive system of claim 16 wherein said actuation balls cooperate with said races formed in said first hub and said races formed in said second hub to move said second hub to its first position upon rotation of said input shaft in said first direction and to move said second hub to its second position upon rotation of said input shaft in a second direction.

18. The drive system of claim 10 further comprising a basket drive shaft fixedly connected to said second hub.

19. The drive system of claim 10 further comprising a transmission connected to said input shaft and an agitator drive shaft connected to said transmission, said transmission converting continuous rotation of said input shaft in one direction into reciprocating back and forth rotation of said agitator drive shaft.

* * * * *